US006404306B1

(12) United States Patent
Kitajima et al.

(10) Patent No.: US 6,404,306 B1
(45) Date of Patent: Jun. 11, 2002

(54) DIELECTRIC CERAMIC FILTER WITH IMPROVED ELECTRICAL CHARACTERISTICS IN HIGH SIDE OF FILTER PASSBAND

(75) Inventors: Masahiko Kitajima; Hiroshi Nakamura; Kosuke Nishimura, all of Ube (JP)

(73) Assignee: Ube Electronics, Ltd., Mine (JP)

( * ) Notice: Subject to any disclaimer, the term of this patent is extended or adjusted under 35 U.S.C. 154(b) by 0 days.

(21) Appl. No.: 09/527,420

(22) Filed: Mar. 17, 2000

(51) Int. Cl.[7] ..... H01P 1/20; H01P 7/04
(52) U.S. Cl. ..... 333/206; 333/202; 333/222
(58) Field of Search ..... 333/202, 206, 333/207, 222

(56) References Cited

U.S. PATENT DOCUMENTS 4,823,098 A * 4/1989 DeMuro et al. ..... 333/206
5,124,676 A * 6/1992 Ueno ..... 333/206
5,227,747 A * 7/1993 Komazaki et al. ..... 333/206
6,169,465 B1 * 1/2001 Kim et al. ..... 333/206
6,177,852 B1 * 1/2001 Tada et al. ..... 333/202

FOREIGN PATENT DOCUMENTS

GB 2163606 A 2/1998

* cited by examiner

*Primary Examiner*—Robert Pascal
*Assistant Examiner*—Patricia T. Nguyen
(74) *Attorney, Agent, or Firm*—Maxim H. Waldbaum

(57) ABSTRACT

A ceramic block filter is designed with a shunt transmission line to attenuate third harmonics. A metallized belt is printed on the top surface of the filter along its edges so that it is connected to the metallized ground of the side surfaces. Along one edge an unmetallized line is left along one edge of the filter, whose ends are grounded. The unmetallized line is designed with a length greater than one-half of the length of the metallized belt, but smaller than the length of the metallized belt. The length and width of the unmetallized line are design choices for the specific frequencies sought to be attenuated.

3 Claims, 4 Drawing Sheets

DIELECTRIC CERAMIC FILTER WITH IMPROVED ELECTRICAL CHARACTERISTICS IN HIGH SIDE OF FILTER PASSBAND

FIELD OF THE INVENTION

This invention relates to ceramic block filters with high performance in a small package. More specifically, the present invention relates to a new design for a high performance dielectric ceramic filter that is smaller than conventional filters with comparable performance specifications and which is designed to reduce second and third order harmonics.

BACKGROUND OF THE INVENTION

A ceramic body with a coaxial hole bored through its length forms a resonator that resonates at a specific frequency determined by the length of the hole and the effective dielectric constant of the ceramic material. The holes are typically circular, or elliptical. A dielectric ceramic filter is formed by combining multiple resonators, each of the resonators passing through the entire ceramic block, from the top surface to the bottom surface, such that the depth of each hole is the same as the axial length of the filter. The design choice for a specific axial length of a filter depends on the desired frequency and the dielectric constant of the selected ceramic.

The ceramic block functions as a filter because the resonators are coupled inductively and/or capacitively between every two adjacent resonators. These couplings are formed by the electrode pattern which is designed on the top surface of the ceramic block and plated with a conductive material such as silver or copper. More specifically, and with reference to FIGS. 1A–D, a ceramic block 101 is shown with two holes 103 and 105. All surfaces, except for the front open face 107 through which the two holes 103 and 105 extend, are plated with silver. Due to the size of the holes, their proximity and the conductive coating, the two holes 103 and 105 are inductively and capacitively coupled to each other. However, block 101 will not perform as a filter because these couplings cancel each other out.

To form a filter, a pattern of conductive material is printed on face 107, as shown in FIG. 1B. In this embodiment the patterns A and A' enhance the capacitive coupling between holes 103 and 105. While the capacitive coupling is enhanced, the inductive coupling remains substantially unaffected. This is because inductive coupling is mostly a function of the hole diameter, shape and spacing between holes. These parameters are the same in FIGS. 1A and 1B.

The capacitive coupling can be regulated in FIG. 1B by adjusting parameters L and G. By decreasing G or increasing L, the capacitive coupling is strengthened. The capacitive coupling can also be weakened such that the inductive coupling is stronger, by printing line M on open face 107. The simple line M in FIG. 1C has a greater diminishing effect on the capacitive coupling of the block filter 101, than the broken line M' of FIG. 1D.

Ceramic filters are well known in the art and are generally described for example in U.K. Patent No. GB2163606 which is hereby incorporated by reference as if fully set forth herein.

With respect to its performance, it is known in the art that the band pass characteristics of a dielectric ceramic filter are sharpened as the number of holes bored in the ceramic block are increased. The number of holes required depends on the desirable attenuation properties of the filter. Typically a simplex filter requires at least two holes while a duplexer (having a transmitter filter and a receiver filter) requires more than three holes. This is illustrated in FIG. 2 where graph 10 represents the filter response with fewer holes than graphs 12 and 14. It is apparent that graph 14 which is the response of the filter with the most holes, is the sharpest of the three responses shown. Referring to FIG. 3, it can be seen that the band pass characteristic of a particular dielectric ceramic filter is also sharpened with the use of trap holes bored into the ceramic block. Solid line graph 21 represents the response of a filter without a high-end trap. Dashed line graph 23 represents the response of the same filter with a high-end trap.

Trap holes, or traps as they are commonly referred to are resonators which resonate at a frequency different from the primary filter holes, commonly referred to simply as holes. They are designed to resonate at the undesirable frequencies. Thus, the holes collect the desirable frequencies while the traps remove the undesirable frequencies, whether low end or high end. In this manner the bandwidth characteristic of the filter is defined, i.e. high pass, low pass, or band pass.

Block filters give rise to second and third harmonics which cause electrical problems, including noise, in many applications including cellular telephones. The designer and user of a bandpass filter generally expects that the filter will have a response only within the range of frequencies for which it is designed. Filters that have second and third order harmonics, however, have responses for one or more ranges of frequency above the bandpass of the filter. Specifically, the third harmonic typically arises since the quarter wavelength resonantors used in block filters also resonate at three-quarter wavelengths, i.e. the third harmonic. The second harmonic typically is a consequence of the structure of the block filter.

While the second harmonic is suppressed by controlling the dimensions of the block filter, the third harmonic is typically controlled with low pass filters to block these higher ranges of frequency. Alternative methods include the use of step impendance holes in the filter.

With both low pass filter and step impedance solutions to attenuating the higher order harmonics, the block filters involve additional complexity, thereby increasing the cost of the filter. Furthermore, with low pass filters, either a separate low pass filter is needed on the PC board, or additional holes are used to block second and third order harmonics. As a result, either the size of the filter increases as compared with a similar block filter without the additional low pass filter, or additional room on the PC board is required for the additional low pass filter. This is of serious concern since one of the principle purposes of a block filter is to provide a high performance filter in a package as small as possible. Accordingly, it is desirable to design a ceramic filter that will reduce the effects of second and third harmonics without increasing the size or cost of the filter.

SUMMARY OF THE INVENTION

A metallized belt pattern is printed on the top face of a ceramic block filter which ordinarily has the printed conductive pattern, and connected to ground at the bottom of the filter. The metallized pattern at the side of the ground has an unmetallized line along at least one edge of the filter. This combination of the metallized belt and unmetallized line acts as a transmission line whose ends are short circuited and controls the third harmonic. The width of the metallized pattern and unmetallized line is a matter of design choice to attenuate second and third harmonics.

DETAILED DESCRIPTION OF THE INVENTION

A signal generated in an electronic device will generally comprise the base signal and higher order harmonics. It is generally advantageous to eliminate or at very least to minimize to the extent possible the power level of the higher order harmonics before the combined signal reaches the antenna of the electronic device and is transmitted. Ceramic filters, used to select the frequency range to reach the antenna, are not effective in the absence of specific design elements, to filter out the higher order harmonics. Traditionally these specific design elements included low pass filters and step impedance filters. These design elements, however, have the undesirable effect of increasing the size of the block filter, or an additional low pass filter is needed on the PC board.

Figure 1A:
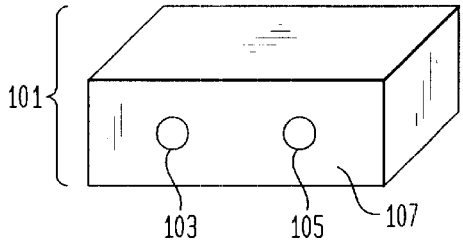
FIG. 1A illustrates the open face surface of a ceramic block plated with silver on all other surfaces.
Figure 1B:
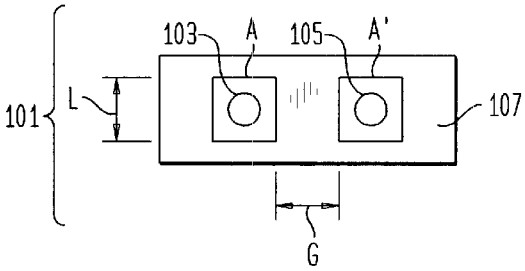
FIG. 1B illustrates the ceramic block of FIG. 1A, but with a printed pattern on the open face surface.
Figure 1C:
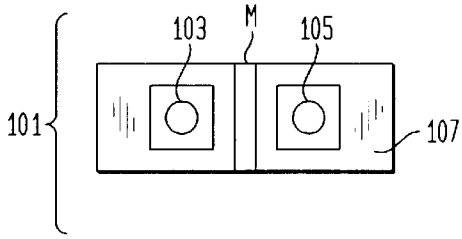
FIG. 1C illustrates the ceramic filter of FIG. 1B with a second printed pattern.
Figure 1D:
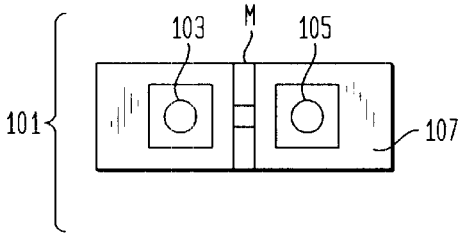
FIG. 1D illustrates the ceramic filter of FIG. 1C with a third printed pattern.
Figure 2:
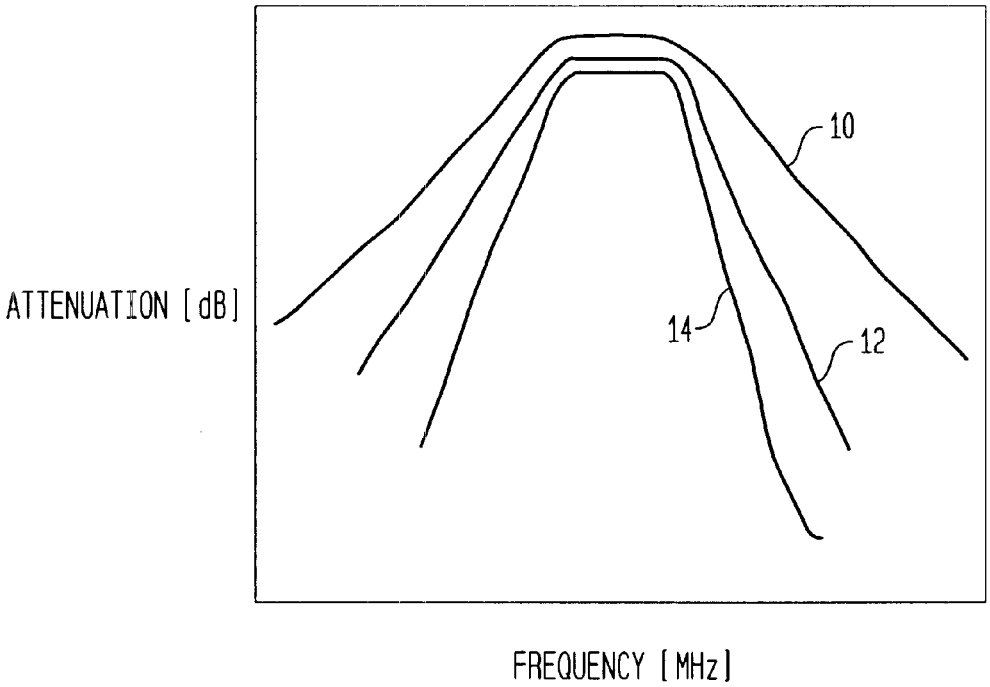
FIG. 2 illustrates the increased sharpness of the band pass response of a dielectric block filter as the number of holes in the filter increase.
Figure 3:
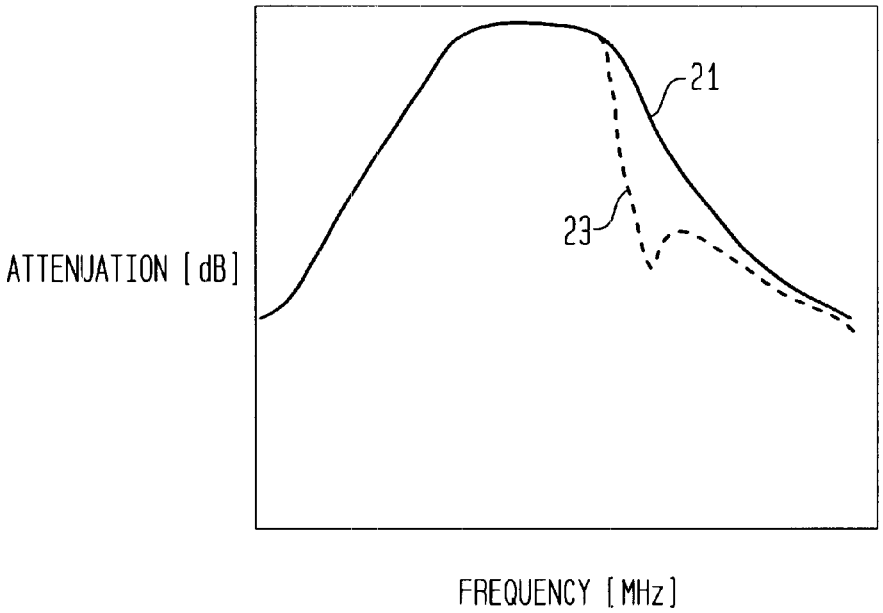
FIG. 3 illustrates the effectiveness of traps in removing high-end frequencies.
Figure 4:
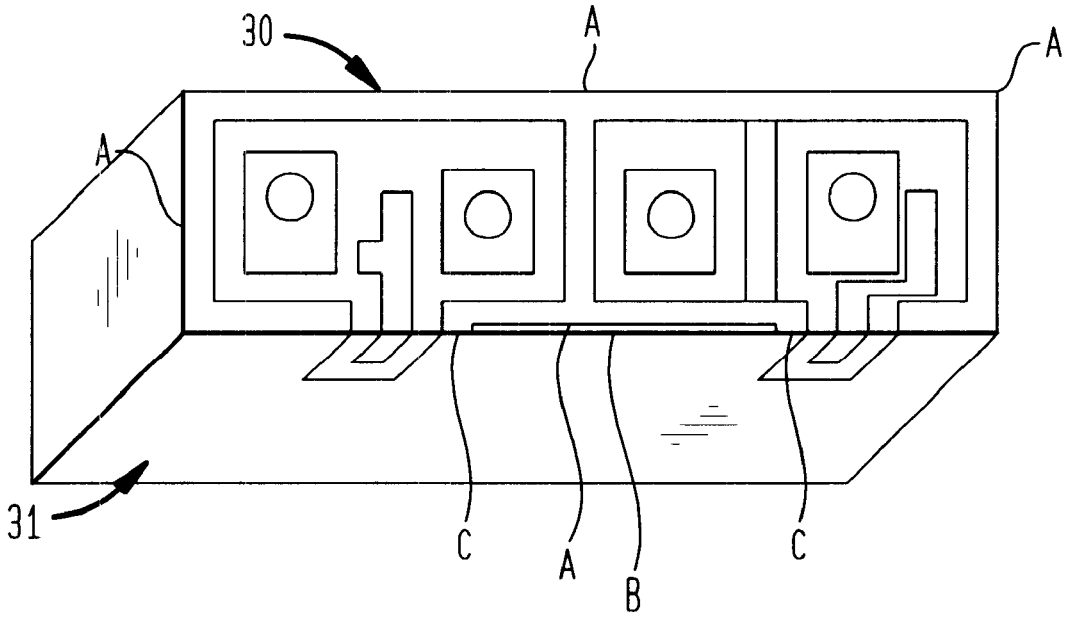
FIG. 4 is an overhead oblique view of the top face of a dielectric block filter with a metallized pattern in accordance with the present invention.

Thus in accordance with the present invention and with reference to FIG. 4 an improved conductive pattern may be used to attenuate the second and third harmonics so that they are not forwarded to the antenna and transmitted with the base signal. Referring to FIG. 3, the metallized pattern A is printed around the edges of the top surface of the filter and connected to ground at the mounting surface 31 (i.e. side wall with 1/0 electrodes) of the filter 30. This may be accomplished in a variety of patterns. Most simply, where the side-walls of the filter are substantially covered with a conductive material and connected to the ground, a metal belt may simply be printed along the top edge of the filter so that it is electrically connected to the conductive material on the side walls 31. Indeed, the metal belt A shown in FIG. 4 is an extension of the four metallized side-walls 31.

In accordance with the present invention, to attenuate the signal level that corresponds to the second and the third harmonics the metallized belt A is combined on the surface of filter 30 with an unmetallized line B, which performs as a transmission line whose ends C are grounded. This transmission line acts as a shunt. By adjusting the physical dimensions of the unmetallized line B the appropriate frequencies, in this case the third harmonic, is attenuated.

Figure 5:
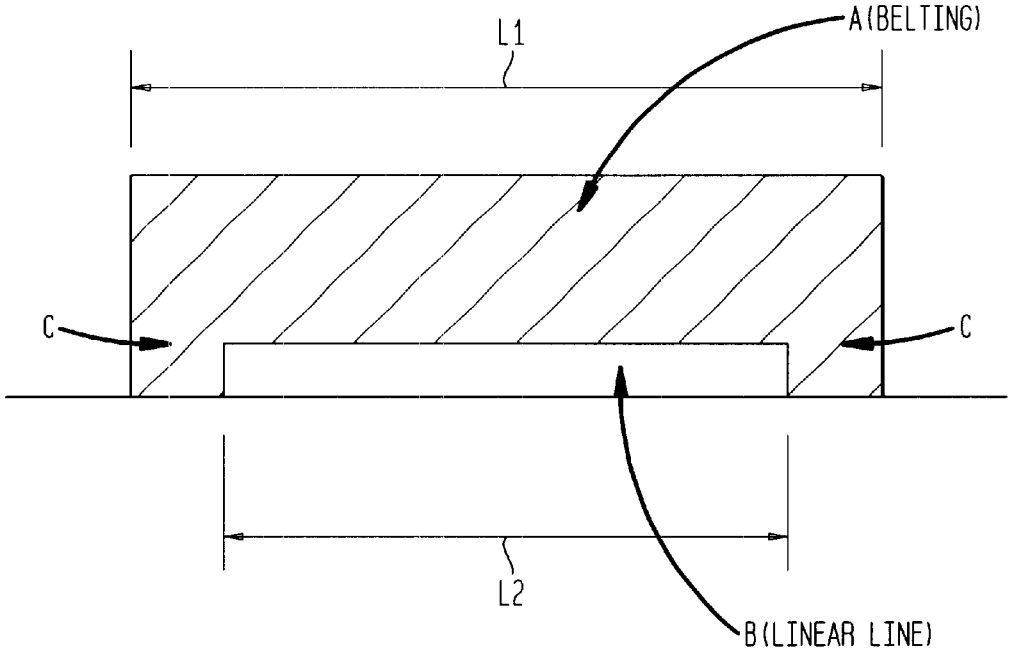
FIG. 5 is an enlarged view of the portion of the dielectric block filter top face pattern shown in FIG. 4, which includes an unmetallized linear portion.

Referring to FIG. 5, one preferred embodiment of the unmetallized portion B of the conductive pattern from the top face of a block filter in accordance with the present invention is shown. Specifically, this portion B is shown with a linear geometry and positioned along one edge of the top face of the ceramic block. In this embodiment, the entire length L2 of unmetallized portion B, from the front-top edge adjacent portion B and inward for a predetermined distance, is free of any conductive material. This distance is between 0.1 mm and 2.0 mm.

As can be seen from both FIGS. 4 and 5, running alongside unmetallized portion B for a length L2 is metallized belt pattern A. However, on either side of B, A extends as portions C which project to the edge of the top surface of filter 30 so that the combined A-C metallized portion comes in contact with the conductive material on the front face 31 of the block filter 30. This has the effect of grounding the ends of portion B. The combined length of the portion of A running alongside B, and the two metallized extensions C, equals L1. It should be noted that the length L2 of the unmetallized portion B should be greater than one half of L1, but less than L1.

Figure 6:
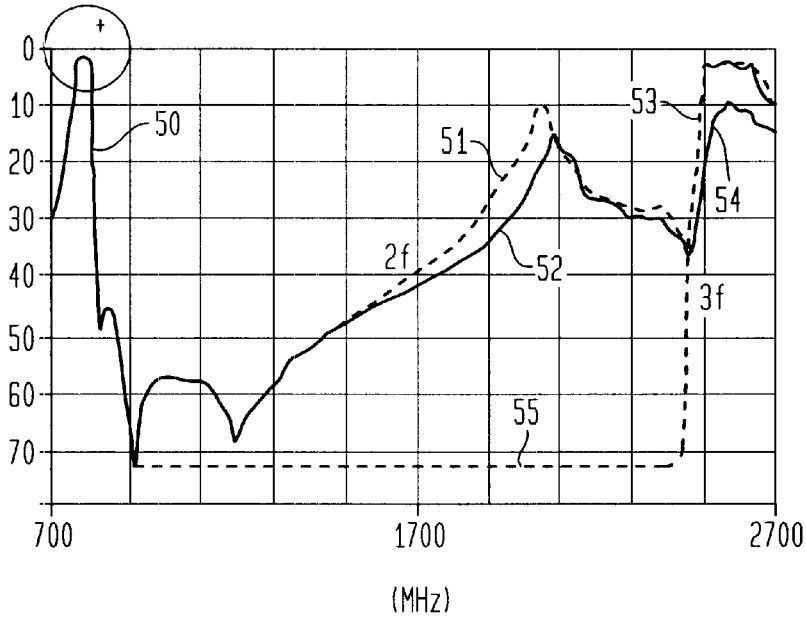
FIG. 6 includes three graphs illustrating (i) the theoretical response of a block filter with no second harmonic; (ii) a typical response of a block filter with a second harmonic response; and (iii) the response of a block filter in accordance with the present invention with the third harmonic attenuated.

Referring to the three graphs of FIG. 6, the response of three band pass filters are shown. The long dashed line represents the theoretical response of a bandpass filter with no second harmonic response. After the approximately 1100 MHz cutoff from the desired band pass 50, there is relatively no response except for the third harmonic 3, from the filter. The more realistic filter response, however, is shown by the short dashed line graph. This represents the frequency response of a typical block filter with second and third harmonics shown at 51 and 53, respectively. The solid line depicts the frequency response of the same filter, but modified in accordance with the present invention. As shown, the third harmonic has been attenuated. As apparent from the graph, the filter of the present invention provides improvement by 5 dB to 10 dB in the electrical characteristics of the filter over that of the prior art. Furthermore, by not requiring low pass filters it is able to outperform the prior art filters in a smaller package.

The foregoing merely illustrates the principles of the present invention. Those skilled in the art will be able to devise various modifications, which although not explicitly described or shown herein, embody the principles of the invention and are thus within its spirit and scope.

What is claimed is:

1. A block filter comprising:

a block of dielectric material having a top surface, a bottom surface, two opposing side-walls connecting said top surface to said bottom surface along the width of said block and two opposing side-walls connecting said top surface to said bottom surface along the height of said block, wherein said bottom surface and side walls are substantially covered with conductive material;

at least two holes extending through said dielectric material from said top surface to said bottom surface, wherein the inner surface of said holes are substantially covered with conductive material;

conductive material layered on said top surface in a geometrical pattern such that the combination of said at least two holes and said pattern of conductive material form an equivalent electrical circuit having capacitance and inductance which when subjected to a power source has a frequency response within a desired bandpass;

a pattern of conductive material on said top surface, said conductive material being electrically grounded and arranged in a pattern so as to form an area of dielectric material on said top surface, said area of dielectric material having a geometry and dimensions so as to attenuate the frequency response of said block filter which is above said bandpass; and said area of dielectric material is rectangular in geometry, and surrounded from all sides by electrically grounded conductive material.

2. The block filter of claim 1 wherein said rectangular area of dielectric material is bordered on one side by an edge of said top surface joining a side wall and wherein said side wall is layered with an electrically grounded conductive material, said electrically grounded conductive material surrounding said area of dielectric material comprising said layered side wall from one side of said rectangular area of dielectric material and said electrically grounded conductive material on said top surface from the other sides of said area of dielectric material.

3. The block filter of claim 2 wherein said rectangular area of dielectric material has a width measured from said top surface-side wall edge border of said rectangular area to said electrically grounded conductive material on said top surface, of approximately 0.1 mm to 2.0 mm.

* * * * *